US008697618B2

(12) United States Patent
Bodesheim et al.

(10) Patent No.: US 8,697,618 B2
(45) Date of Patent: Apr. 15, 2014

(54) METHOD OF USING IONIC LIQUIDS TO IMPROVE THE LUBRICATION OF CHAINS, STEEL BELTS, WHEEL BEARINGS, ROLLER BEARINGS, AND ELECTRIC MOTORS

(75) Inventors: Günther Bodesheim, Munich (DE); Martin Schmidt-Amelunxen, Roehrmoos/Arzbach (DE); Dieter Sohn, Neugreifenberg/Ammersee (DE); Stefan Grundel, Mering (DE); Andrea Hoepke, Mainhausen (DE)

(73) Assignee: Klüber Lubrication München KG, Müchen (DE)

( * ) Notice: Subject to any disclaimer, the term of this patent is extended or adjusted under 35 U.S.C. 154(b) by 0 days.

(21) Appl. No.: 13/445,314

(22) Filed: Apr. 12, 2012

(65) Prior Publication Data

US 2012/0202724 A1 Aug. 9, 2012

Related U.S. Application Data

(62) Division of application No. 12/452,218, filed as application No. PCT/EP2008/004036 on May 20, 2008, now abandoned.

(30) Foreign Application Priority Data

Jun. 20, 2007 (DE) ..... 10 2007 028 427

(51) Int. Cl.

| | |
|---|---|
| ***C10L 1/22*** | (2006.01) |
| ***C07C 317/22*** | (2006.01) |
| ***G11B 5/725*** | (2006.01) |
| ***C10M 133/40*** | (2006.01) |
| ***C10M 141/10*** | (2006.01) |
| ***C07D 207/26*** | (2006.01) |
| ***C10M 169/04*** | (2006.01) |
| ***C10M 135/00*** | (2006.01) |
| ***C10M 135/22*** | (2006.01) |

(52) U.S. Cl.

USPC ..... 508/243; 508/244; 508/255; 508/262; 508/268; 508/302; 508/304; 508/421; 508/547; 508/567

(58) Field of Classification Search

USPC ..... 252/400.2; 508/243, 244, 255, 262, 508/268, 302, 304, 421, 547, 567

See application file for complete search history.

(56) References Cited

U.S. PATENT DOCUMENTS

| | | | | |
|---|---|---|---|---|
| 2005/0090409 | A1 | 4/2005 | Devlin et al. | |
| 2006/0272900 | A1 * | 12/2006 | Clyne | 184/15.1 |
| 2007/0027038 | A1 | 2/2007 | Kamimura et al. | |
| 2009/0281008 | A1 | 11/2009 | Fujinami et al. | |

FOREIGN PATENT DOCUMENTS

| | | | |
|---|---|---|---|
| JP | 2005-336309 | A | 12/2005 |
| JP | 2007-112828 | A | 5/2007 |
| WO | 2006/109652 | A1 | 10/2006 |

* cited by examiner

*Primary Examiner* — Harold Pyon
*Assistant Examiner* — Tanisha Diggs
(74) *Attorney, Agent, or Firm* — Roberts Mlotkowski Safran & Cole, P.C.; David S. Safran

(57) ABSTRACT

A method in which an improved lubricating composition containing ionic liquids is used to enable operation of chains, steel belts, wheel bearings, roller bearings, sliding bearings and electric motors for at least 48 hours by reducing the evaporation loss and the lackification tendency of the lubricant due to the lubricant being protected against thermal and oxidative attack.

12 Claims, No Drawings

METHOD OF USING IONIC LIQUIDS TO IMPROVE THE LUBRICATION OF CHAINS, STEEL BELTS, WHEEL BEARINGS, ROLLER BEARINGS, AND ELECTRIC MOTORS

CROSS REFERENCE TO RELATED APPLICATION

This application is a divisional of U.S. patent application Ser. No. 12/452,218, filed Mar. 22, 2010, now abandoned, which is an application filed under 35 U.S.C. 371 of PCT/EP2008/004036, filed May 20, 2008, which claims priority from German Application DE 10 2007 028 427.8, filed Jun. 20, 2007.

BACKGROUND OF THE INVENTION

1. Field of Invention

The invention relates to the method of using ionic liquids to improve the lubrication effect of synthetic, mineral and native oils during operation of chains, steel belts, wheel bearings, roller bearings, and electric motors. In particular the invention relates to such a method in which an improved lubricating composition that is protected against thermal and oxidative attack enables operation of chains, steel belts, wheel bearings, roller bearings, and electric motors for at least 48 hours by reducing the evaporation loss and the lackification tendency of the lubricant.

2. Description of Related Art

Lubricants are used in automotive engineering, conveyor technology, mechanical engineering, office technology and in industrial factories and machines but also in the fields of household appliances and entertainment electronics.

In roller bearings, sliding bearings (contacts) and friction bearings, lubricants ensure that a separating film of lubricant which transfers the load is built up between parts rolling or sliding against one another. This achieves the result that the metallic surfaces do not come in contact and therefore no wear occurs. These lubricants must therefore meet high demands, which include extreme operating conditions such as very high or very low rotational speeds, high temperatures due to high rotational speeds or due to outside heating, very low temperatures, e.g., in bearings that operate in a cold environment or that occur with use in aeronautics and space travel. Likewise, modern lubricants should be usable under so-called clean room conditions to prevent contamination of the clean room due to abrasion and/or consumption of lubricants. Furthermore, when using modern lubricants, they should be prevented from vaporizing and therefore "lackifying," i.e., becoming solid after a brief use and therefore no longer having a lubricating effect. Special demands are also made of lubricants during use, so that the running properties of the bearings are not attacked thanks to low friction, the bearings must run with a low noise level and with long running times must be achieved without relubrication. Lubricants must also resist the action of forces such as centrifugal force, gravitational force and vibrations.

The service life and lubricating effect of synthetic, mineral and native oils are limited by their thermal and oxidative degradation. Therefore, amine and/or phenolic compounds have been used in the past as antioxidants, but they have the disadvantage that they have a high vapor pressure and a short lifetime, which is why the oils "lackify" after a relatively short period of use, i.e., they become solid and therefore can cause major damage to the equipment especially in the area of roller bearings, sliding bearings (contacts) and friction bearings.

DETAILED DESCRIPTION OF THE INVENTION

The goal of the present invention is, therefore, to provide a lubricating composition which will meet the requirements specified above and whose thermal and oxidative stability will be improved in comparison with known lubricants for operation of chains, steel belts, wheel bearings, roller bearings, sliding bearings (contacts) and electric motors.

This goal has surprisingly been achieved by adding ionic liquids to synthetic, mineral and native oils. A lubricating composition is provided, comprised of a base oil of a synthetic oil, a mineral oil or a native oil, individually or in combination, to which ionic liquids and optionally conventional additives are added. It has been found that the addition of ionic liquids prolongs the lifetime of the oils and thus the service life by significantly delaying thermal and oxidative degradation.

The synthetic oils are selected from esters of aromatic or aliphatic di-, tri- or tetracarboxylic acids with one or a mixture of $C_7$ to $C_{22}$ alcohols, a polyphenyl ether or alkylated di- or triphenyl ether, an ester of trimethylolpropane, pentaerythritol or dipentaerythritol with aliphatic $C_7$ to $C_{22}$ carboxylic acids, from $C_{18}$ dimeric acid esters with $C_7$ to $C_{22}$ alcohols, from complex esters, as single components or in any mixture. In addition, the synthetic oil may be selected from poly-$\alpha$-olefins, alkylated naphthalenes, alkylated benzenes, polyglycols, silicone oils, perfluoropolyethers.

The mineral oils may be selected from paraffin-based oils, naphthene-based and aromatic hydrocracking oils; GTL fluids. GTL stands for the gas-to-liquid process and describes a method of producing fuel from natural gas. Natural gas is converted by steam reforming to synthesis gas, which is then converted to fuels by means of catalysts according to Fischer-Tropsch synthesis. The catalysts and the process conditions determine which type of fuel is produced, i.e., whether gasoline, kerosene, diesel or oils will be produced. In the same way, coal may also be used as a raw material in the coal-to-liquid process (CTL) and biomass may be used as a raw material in the biomass-to-liquid (BTL) process.

Triglycerides from animal/plant sources may be used as native oils and may be refined by known methods such as hydrogenation. The especially preferred triglycerides are triglycerides with a high oleic acid content. Vegetable oils with a high oleic acid include safflower oil, corn oil, canola oil, sunflower oil, soy oil, linseed oil, peanut oil, lesquerella oil, meadowfoam oil and palm oil. Such oils can also be modified by chemical reactions like radical, anionic or cationic polymerization.

The use of native oils based on renewable raw materials in particular is important because of their advantages with regard to biodegradability and reducing or preventing $CO_2$ emissions because it is possible in this way to avoid the use of petroleum as a raw material while achieving identical if not better results with native oils.

Ionic liquids, hereinafter also referred to as IL (=ionic liquid), are so-called salt melts which are preferably liquid at room temperature and/or by definition have a melting point <100° C. They have almost no vapor pressure and therefore have no cavitation properties. In addition, through the choice of the cations and anions in the ionic liquids, the lifetime and lubricating effect of the lubricating composition are increased, the lackification described above is delayed, and by adjusting the electric conductivity, it is now possible to use these liquids in equipment in which there is an electric charge buildup. Suitable cations for ionic liquids have been found to include a quaternary ammonium cation, a phosphonium cation, an imidazolium cation, a pyridinium cation, a pyrazolium cation, an oxazolium cation, a pyrrolidinium cation, a piperidinium cation, a thiazolium cation, a guanidinium cation, a morpholinium cation, a trialkylsulfonium cation or a triazolium cation, which may be substituted with an anion selected from the group consisting of $[PF_6]^-$, $[BF_4]^-$, $[CF_3CO_2]^2$, $[CF_3SO_3]^-$ as well as its higher homologs, $[C_4F_9—SO_3]$ or $[C_8F_{17}—SO_3]^-$ and higher perfluoroalkylsulfonates, $[(CF_3SO_2)_2N]^-$, $[(CF_3SO_2)(CF_3COO)]^-$, $[R^4—SO_3]^-$, $[R^4—O—SO_3]^-$, $[R^4—COO]^-$, $Cl^-$, $Br^-$, $[NO_3]^-$, $[N(CN)_2]^-$, $[HSO_4]^-$, $PF_{(6-x)}R^6_x$ or $[R^4R^5PO_4]^-$ and the radicals $R^4$ and $R^5$ independently of one another are selected from hydrogen; linear or branched, saturated or unsaturated, aliphatic or alicyclic alkyl groups with 1 to 20 carbon atoms; heteroaryl, heteroaryl-$C_1$-$C_6$-alkyl groups with 3 to 8 carbon atoms in the heteroaryl radical and at least one heteroatom of N, O and S, which may be combined with at least one group selected from $C_1$-$C_6$ alkyl groups and/or halogen atoms; aryl-aryl $C_1$-$C_6$ alkyl groups with 5 to 12 carbon atoms in the aryl radical, which may be substituted with at least one $C_1$-$C_6$ alkyl group; $R^6$ may be a perfluoroethyl group or a higher perfluoroalkyl group, x is 1 to 4. However, other combinations are also possible. A special important example of $PF_{(6-x)}R^6_X$ is $F_3P(C_2F_5)_3$ Ionic liquids with highly fluorinated anions are especially preferred because they usually have a high thermal stability. The water uptake ability may definitely be reduced by such anions, e.g., in the case of the bis(trifluoromethylsulfonyl) imide anion and the tris(pentafluoroethyl)trifluorophosphate Examples of such ILs include:

butylmethylpyrrolidinium bis(trifluoromethylsulfonyl)imide (MBPimide), methylpropylpyrrolidinium bis(trifluoromethylsulfonyl) imide (MPPimide), hexylmethylimidazolium tris(perfluoroethyl)trifluorophosphate (HMIMPFET), hexylmethylimidazolium bis(trifluoromethylsulfonyl)imide (HMIMimide), hexylmethylpyrrolidinium bis(trifluoromethylsulfonyl) imide (HMP), tetrabutylphosphonium tris(perfluoroethyl)trifluorophosphate (BuPPFET), octylmethylimidazolium hexafluorophosphate (OMIM PF6), hexylpyridinium bis(trifluoromethyl)sulfonylimide (Hpyimide), methyltrioctylammonium trifluoroacetate (MOAac), butylmethylpyrrolidinium tris(pentafluoroethyl)trifluorophosphate (MBPPFET), trihexyl(tetradecyl)phosphonium bis(trifluoromethylsulfony)imide (HPDimide).

trihexyl(tetradecyl)phosphonium tris(pentafluoroethyl)trifluorophosphate (HPDPFET).

In addition, the inventive lubricating compositions contain the usual additives or additive mixtures selected from anticorrosion agents, antioxidants, wear preservatives, friction-reducing agents, agents to protect against the effects of metals which are present as chelate compounds, radical scavengers, UV stabilizers, reaction-layer-forming agents; organic or inorganic solid lubricants such as polyimide, polytetrafluoroethylene (PTFE), graphite, metal oxides, boron nitride, molybdenum disulfide and phosphate. In particular, additives in the form of compounds containing phosphorus and sulfur, e.g., zinc dialkyl dithiophosphate, boric acid esters may be used as antiwear/extreme pressure agents, metal salts, esters, nitrogenous compounds, heterocyclic agents may be used as anticorrosion agents, glycerol monoesters or diesters may be used as friction preservatives and polyisobutylene, polymethacrylate may be used as viscosity modifiers.

The inventive lubricating compositions comprise (a) 99.3 to 30 weight % of a base oil or a base oil mixture, (b) 0 to 50 weight % of a polymer or polymer mixture based on polyisobutylene, which can be partly or fully hydrogenated; (c) 0.2 to 10 weight % of an ionic liquid or mixtures of ionic liquids; and (e) 0.5 to 10 weight % of additives or additive mixtures.

The inventive lubricating compositions may be used as high-temperature chain oils by adding ionic liquids because they may be used at temperatures up to 250° C. By lowering the electric resistance of the oils, they may be used in areas where repeated damage incidents due to electricity due sparkovers, as in the case of railway wheel bearings and roller bearings with a current feed-through, and in the automotive field or with electric motors, for example.

Ionic liquids are superior to phenol-based or amine-based antioxidants or perfluorinated salts as thermal and oxidative stabilizers due to the solubility in organic systems and/or solvents and/or because of the extremely low vapor pressure. Also, in the case that ionic liquids are used in large amounts in the lubricants, no crystallization formation was found which can lead to noise development and obstructions in mechanical seals and thereby damaging these components. The thermal and oxidative stability of the inventive lubricating compositions is manifested in the delay in evaporation and the increase in viscosity, so that the lackification of the system at high temperatures is delayed and the lubricants can be used for a longer period of time.

The advantages of the inventive lubricating compositions are shown on the basis of the following examples.

EXAMPLES

The percentage amounts are given in percent by weight (wt %), unless otherwise indicated.

1. Reduction in the Electric Resistance of the Oils Due to the Addition of Ionic Liquids Various base oils were measured alone and in combination with various ionic liquids in various concentrations. The polypropylene glycol that is used is a butanol-initiated polypropylene glycol. The synthetic ester is dipentaerythritol ester with short-chain fatty acids available under the brand name Hatco 2926.

The measurements of the specific electric resistivity were performed with plate electrodes having an area of 2.5 $cm^2$ and a spacing of 1.1 cm with a measurement voltage (DC) of 10 V. Three measurements were performed for each, and Table 1 shows the averages of the measurements.

TABLE 1

| Lubricating oilComposition) | Specific Electric Resistivity (Ω cm) |
|---|---|
| 100% polypropylene glycol | $10 \times 10^{10}$ |
| 99.0% polypropylene glycol + 1% HDPimide | $6 \times 10^{6}$ |
| 100% synthetic ester | $7 \times 10^{10}$ |
| 99.0% synthetic ester + 1% HDPimide | $7 \times 10^{6}$ |
| 95.0% synthetic ester + 5% HDPimide | $1 \times 10^{6}$ |
| 100% solvent raffinate N 100/40 pure | $<10^{13}$ |
| 99.0% solvent raffinate N 100/40 + 1% PCl | $1 \times 10^{11}$ |
| 99.9% solvent raffinate N 100/40 + 0.1% PCl | $1 \times 10^{12}$ |

HDPimide: trihexyl(tetradecyl)phosphonium bis(trifluoromethylsulfonyl)imide
PCl: trihexyltetradecylphosphonium chloride The measurement results thus obtained show that by adding ionic liquids, the specific electric resistivity of the lubricating oil composition is lowered.

2. Influence of the Ionic Liquids on the Coefficient of Friction and the Wear Rate on the Example of a Polypropylene Glycol n-Butanol-initiated polyalkylene glycol available under the brand name Synalox 55-150B was used. A vibration friction wear test (SRV) was performed according to DIN 51834, test conditions: ball/plate, 200 N load at 50° C., 1 mm stroke at 50 Hz for 20 minutes. The results are shown in Table 2.

TABLE 2

| Lubricating oil Composition | Wear factor/form of friction signal with time/coefficient of friction |
|---|---|
| 100% polyalkylene glycol | 2850/slightly wavy/0.15 |
| 99.5% polyalkylene glycol + 0.5% OMIM PF6 | 41/very smooth/0.11 |
| 98.0% polyalkylene glycol + 2% OMIM PF6 | 108/very smooth/0.11 |

OMIM PF6: octylmethylimidazolium hexafluorophosphate

These results show the positive influence of the ionic liquids on the coefficient of friction and on the wear rate of the lubricating composition.

3. Influence of the Ionic Liquids on the Viscosity and the Loss on Evaporation of Lubricating Grease Compositions These investigations were first conducted at 150° C. with 1 g weight of the lubricating grease composition. To do so, the samples were weighed into aluminum dishes and tempered in a circulating air oven, namely for 96 and 120 hours in the present case. After the test time, the cooled dishes were weighed and the weight loss relative to the initial weight was determined. The apparent dynamic viscosity of the fresh oils as well as the used oils was determined using a ball/plate rheometer at 300 $sec^{-1}$ at 25° C. after a measurement time of 60 seconds.

In addition, thermogravimetric analysis (TGA) were performed using a TG/DTA 6200 device from the company Seiko with an initial weight of 10 mg±0.2 mg in an open aluminum crucible, purging gas air, temperature ramp 1 K/min from 100 to 260° C. Dipentaerythritol ester with short-chain fatty acids, available under the brand name Hatco 2926 was used as the synthetic ester for these analyses. The percentage amounts are wt %. The results are shown in Table 3.

TABLE 3

| Sample | 100% synthetic ester pure | 99.5% synthetic ester + 0.5% HDPimide | 98.0% synthetic ester + 2% HDPimide | 89.6% synthetic ester + 10.4% HDPimide |
|---|---|---|---|---|
| Apparent dynamic viscosity fresh | 130 mPas | 140 mPas | 140 mPas | 160 mPas |
| LOE and apparent dynamic viscosity after 96 hours at 150° C. | 39.6% 13,500 mPas | 21.3% 1400 mPas | 13.6% 580 mPas | 8.5% 360 mPas |
| LOE and apparent dynamic viscosity after 120 hours at 150° C. | 48.5% 70,000 mPas | 25.3% 2400 mPas | 15.7% 700 mPas | 10.6% 460 mPas |
| TGA LOE up to 260° C. according to KL standard | 40.0% | 35.4% | 32.5% | 23.2% |

LOE: loss on evaporation
HDPimide: trihexyl(tetradecyl)phosphonium bis(trifluoromethylsulfonyl)imide These results show that with high-temperature oils, a definite reduction in viscosity and reduction in the loss on evaporation under temperature loading TGA-LOE (5 g initial weight at 230° C.) can be observed in high-temperature oils due to the addition of ionic liquids without the addition of other antioxidants in the lubricating composition.

4. Influence of the ionic liquids on the viscosity and evaporation under thermal loading (1 g initial weight at 200° C.) of the lubricating oil in combination with a known antioxidant. An amine antioxidant (Naugalube 438L) in a concentration of 1 wt % was used in all the samples tested subsequently, while a synthetic ester was used as the base oil. The synthetic ester was a dipentaerythritol ester with short-chain fatty acids available under the brand name Hatco 2926. The ionic liquids used are listed below.

TABLE 4

| Effect on viscosity | | | | | |
|---|---|---|---|---|---|
| Ionic liquid | Oil | Initial viscosity* in mPas | Viscosity in mPas after 24 h | Viscosity in mPas after 48 h | Viscosity in mPas after 72 h |
| — | 99.0% synthetic ester | 173 | lackified | lackified | lackified |
| 0.1% MBPimide | 98.9% synthetic ester | 182 | lackified | lackified | lackified |
| 0.3% MBPimide | 98.7% synthetic ester | 192 | 93,517 | lackified | lackified |
| 0.1% HMP | 98.9% synthetic ester | 176 | 176,740 | lackified | lackified |
| 0.3% HMP | 98.7% synthetic ester | 187 | 63,402 | lackified | lackified |
| 0.1% HMIMimide | 98.9% synthetic ester | 176 | lackified | lackified | lackified |
| 0.3% HMIMimide | 98.7% synthetic ester | 185 | 30,100 | lackified | lackified |
| 0.1% BuPPFET | 98.9% synthetic ester | 176 | lackified | lackified | lackified |
| 0.3% BuPPFET | 98.7% synthetic ester | 181 | 70,776 | lackified | lackified |
| 0.1% HPYimide | 98.9% synthetic ester | 185 | 25,208 | lackified | lackified |
| 0.3% HPYimide | 98.7% synthetic ester | 176 | 4314 | 24,367 | lackified |
| 0.1% MoAac | 98.9% synthetic ester | 176 | lackified | lackified | lackified |
| 0.3% MoAac | 98.7% synthetic ester | 178 | lackified | lackified | lackified |
| 0.1% MBPPFET | 98.9% synthetic ester | 179 | 21,164 | lackified | lackified |
| 0.3% MBPPFET | 98.7% synthetic ester | 181 | 14,817 | 22,392 | lackified |
| 0.1% HMIMPFET | 98.9% synthetic ester | 178 | 79,979 | lackified | lackified |
| 0.3% HMIMPFET | 98.7% synthetic ester | 179 | lackified | lackified | lackified |
| 1.0% MBPimide | 98.0% synthetic ester | 181 | 14,726 | 46,721 | lackified |
| 0.1% HDPimide | 98.9% synthetic ester | 174 | 90,883 | lackified | lackified |
| 0.3% HDPimide | 98.7% synthetic ester | 178 | 55,759 | lackified | lackified |

*Apparent dynamic viscosity after 60 sec shear time at 300 $sec^{-1}$, cone/plate 20° C.
MBPimide = butylmethylpyrrolidinium bis(trifluoromethylsulfonyl)imide
HMP = hexylmethylpyrrolidinium bis(trifluoromethylsulfonyl)imide TABLE 4-continued HMIMimide = hexylmethylimidazolium bis(trifluoromethylsulfonyl)imide
BuPPFET = tetrabutylphosphonium tris(perfluoroethyl)trifluorophosphate
HPYimide = hexylpyridinium bis(trifluoromethyl)sulfonylimide
MOAac = methyltrioctylammonium trifluoroacetate
MBPPFET = butylmethylpyrrolidinium tris(pentafluoroethyl)trifluorophosphate
HMIMPFET = hexylmethylimidazolium tris(perfluoroethyl)trifluorophosphate
HPDimide = trihexyl(tetradecyl)phosphonium bis(trifluoromethylsulfonyl)imide Effect on the loss on evaporation

| Ionic liquid | Oil | Loss on evaporation after 24 hours |
|---|---|---|
| — | 99.0% synthetic ester | 70-75% |
| 0.3 % HMP | 98.7% synthetic ester | 53% |
| 0.3% HPYimide | 98.7% synthetic ester | 39% |
| 0.3% HDPimide | 98.7% synthetic ester | 53% |

The above results show that the increase in viscosity and the loss on evaporation of the lubricants are reduced by the addition of an ionic liquid. Furthermore, it has been shown that a lubricant containing only an amine antioxidant is "lackified" after only 24 hours, whereas lackification does not occur until after 24 to 48 hours when the ionic liquid is added. When 0.3 wt % HPYimide and/or MBPPFET as well as 1.0 wt % MBPimide is/are added, the lubricant does not lackify until 48 to 72 hours. In addition, the loss on evaporation of the lubricants is reduced. Table 5 summarizes the results of Table 4.

TABLE 5

| Lubricating composition | Lackification time |
|---|---|
| 99.0% synthetic ester +1% amine antioxidant | <7 hours |
| 98.9 and/or 98.7% synthetic ester + 1% amine antioxidant + 0.1 and/or 0.3% MBPimide; HMP; HMIMimide; BuPPFET; MBPPFET; HIMIMPFET; HDPimide and/or 0.1% HPYimide or 0.1% MBPPFET | >24 hours and <48 hours |
| 98.9 and/or 98.7% synthetic ester + 1% amine antioxidant + 0.3% HPYimide or MBPPFET or 1.0% MBPimide | >48 hours and <72 hours |

5. Influence of Ionic Liquids on Native Ester Oils with Regard to Evaporation and Viscosity Under Thermal Loading of 1 g Starting Weight at 140° C.

Rümanol 404 blown rapeseed oil was used as the native ester oil. An amine antioxidant (Naugalube 438L) in a concentration of 1 wt % was used in all the samples tested subsequently. The ionic liquids used are listed below.

TABLE 6

| Ionic liquid | Oil | Initial viscosity* in mPas | Viscosity in mPas after 24 h | Viscosity in mPas after 48 h | Viscosity in mPas after 72 h |
|---|---|---|---|---|---|
| — | 99.0% native ester oil | 112 | 20,152 | lackified | lackified |
| 0.1% MoAac | 98.9% native ester oil | 123 | 505 | 39,177 | lackified |
| 0.3% MoAac | 98.7% native ester oil | 127 | 176 | 21,856 | lackified |
| 0.1% Ecoeng 500 | 98.9% native ester oil | 121 | 72,249 | lackified | lackified |
| 0.3% Ecoeng 500 | 98.7% native ester oil | 117 | 34,383 | lackified | lackified |
| 0.1% HDPimide | 98.9% native ester oil | 114 | 14,641 | lackified | lackified |
| 0.3% HDPimide | 98.7% native ester oil | 118 | 15,303 | lackified | lackified |
| 1.0% MOAac | 98.0% native ester oil | 124 | 120 | 1613 | lackified |

*Apparent dynamic viscosity after 60 s shear time at 300 $sec^{-1}$, cone/plate 20° C.
MOAac = methyltrioctylammonium trifluoroacetate
HPDimide = trihexyl(tetradecyl)phosphonium bis(trifluoromethylsulfonyl)imide
Ecoeng 500 = PEG-5 cocomonium methyl sulfate

| Ionic liquid | Oil | Loss on evaporation after 24 hours |
|---|---|---|
| — | 99.0% native ester | 7.0% |
| 0.1 % MOAac | 98.9% native ester | 2.6% |
| 0.3% MOAac | 98.7% native ester | 1.8% |
| 0.1% HDPimide | 98.9% native ester | 2.9% |
| 0.3% HDPimide | 98.7% native ester | 3.0% |
| 1.0% MOAac | 98.0% native ester | 2.0% |

The results above show that the increase in viscosity and the loss on evaporation of the native ester oil are reduced by adding an ionic liquid. In addition, it has been shown that a native ester oil containing only an amine antioxidant is "lackified" after 24 to 48 hours, whereas lackification does not occur until after 48 to 72 hours when the ionic liquid is added. Table 7 summarizes the results of Table 6.

TABLE 7

| Lubricating oil composition | Lackification time |
|---|---|
| 99% native ester oil + 1% amine antioxidant | >24 h and <48 h |
| Native ester oil + 1% amine antioxidant + MOAac in various concentrations from 0.1 to 1% | >48 h and <72 h plus a reduction in viscosity in comparison with the standard! |

6. Influence of Ionic Liquids on Natural Ester Oils with Regard to Evaporation and Viscosity Under Temperature Loading of 1 g Initial Weight at 140° C.

Sunflower oil was used as the natural ester oil. An amine antioxidant (Naugalube 438L) in a concentration of 1 wt % was used in all the samples tested subsequently. The ionic liquids used are listed below.

TABLE 8

| Ionic liquid | Oil | Initial viscosity* in mPas | Viscosity in mPas after 24 h | Viscosity in mPas after 48 h | Viscosity in mPas after 72 h |
|---|---|---|---|---|---|
| — | 99.0% sunflower oil | 102 | 14,190 | lackified | lackified |
| 0.1% MoAac | 98.9% sunflower oil | 113 | 142 | 51,891 | lackified |
| 0.3% MoAac | 98.7% sunflower oil | 108 | 173 | 13,820 | lackified |
| 0.1% Ecoeng 500 | 98.9% sunflower oil | 106 | 4652 | lackified | lackified |
| 0.1% HDPimide | 98.9% sunflower oil | 113 | 5580 | lackified | lackified |
| 0.3% HDPimide | 98.7% sunflower oil | 114 | 4002 | lackified | lackified |
| 1.0% MOAac | 98.0% sunflower oil | 109 | 116 | 1999 | lackified |

*Apparent dynamic viscosity after 60 s shear time at 300 $sec^{-1}$, cone/plate 20° C.
MOAac = methyltrioctylammonium trifluoroacetate
HPDimide = trihexyl(tetradecyl)phosphonium bis(trifluoromethylsulfonyl)imide
Ecoeng 500 = PEG-5-cocomonium methyl sulfate

| Ionic liquid | Oil | Loss on evaporation after 24 hours |
|---|---|---|
| — | 99.0% s unflower oil | 4.5% |
| 0.1% MOAac | 98.9% sunflower oil | 1.9% |
| 0.3% MOAac | 98.7% sunflower oil | 0.6% |
| 0.1% HDPimide | 98.9% sunflower oil | 4.4% |
| 0.3% HDPimide | 98.7% sunflower oil | 4.2% |
| 1.0% MOAac | 98.0% sunflower oil | 1.4% |

The results above show that the loss on evaporation and the increase in viscosity of the natural ester oil are reduced by adding an ionic liquid. In addition, it has been shown that a natural ester oil containing only an amine antioxidant is "lackified" after only 24 to 48 hours whereas lackification does not occur until after 48 to 72 hours when MOAac is added as the ionic liquid. Table 9 summarizes the results of Table 8.

TABLE 9

| Sample composition | Lackification time |
|---|---|
| 99% sunflower oil + 1% amine antioxidant | >24 h and <48h |
| Sunflower oil + 1% amine antioxidant + IL (Ecoeng 500; HDPimide) | >24 h and <48 h but reduced viscosity in comparison with the standard |
| Sunflower oil + 1% amine antioxidant + MOAac in concentrations of 0.1 to 1% | >48 h and <72 h viscosity reduced in comparison with standard |

The examples given above show the advantageous effects of addition of ionic liquids to synthetic, mineral and natural oils with regard to the reduction in viscosity, the reduction in the loss on evaporation and the reduction in the oxidative and thermal degradation of the lubricating compositions.

Additional Examples

Based on a dipentaerythritester as component (a) a Hatcol 5150 (commercially available product) was used for preparation of formulations with different contents of an aminic antioxidant and an ionic liquid given as examples 1 to 6.

The additives readily dissolve in the oil at room temperature.

Table 10 shows the formulation data and the results of a TGA experiment.

The changes of oil viscosity of the formulations are in the expected range.

For the TGA experiments the samples are heated under nitrogen with 10 k/min to 250° C. Then the temperature is kept constant and air as flooding gas is used.

The data show that both the use of the antioxidant and the use of the ionic liquid reduce the evaporation loss.

TABLE 10

| | Hatcol | Ex. 1 | Ex. 2 | Ex. 3 | Ex. 4 | Ex. 5 | Ex. 6 |
|---|---|---|---|---|---|---|---|
| Hatcol 5150 | 100 | 99 | 93 | 95.7 | 95.85 | 96 | 98.7 |
| Diphenylamin, styrenated | 0 | 1 | 4 | 4 | 2.5 | 1 | 1 |
| HDPimid | | 0 | 3 | 0.3 | 1.65 | 3 | 0.3 |
| kinematic viscosity, density ASTM D 7042-04/ASTM D 4052 | | | | | | | |
| Viscosity 40° C. ($mm^2/s$) | 175.35 | 179.96 | 186.60 | 184.51 | 184.65 | 184.32 | 179.96 |
| Viscosity 100° C. ($mm^2/s$) | 17.30 | 17.49 | 17.60 | 17.45 | 17.61 | 17.91 | 17.49 |
| VI | 106.1 | 105.0 | 101.9 | 101.7 | 103.1 | 106.3 | 105.0 |
| density 40° C. ($g/cm^3$) | 0.957 | 0.917 | 0.923 | 0.921 | 0.920 | 0.920 | 0.917 |
| TGA; 4 h, 250° Cira | | | | | | | |
| evaporation loss (%) | 94.8 | 80 | 19.5 | 35.3 | 34.9 | 48.6 | 70.5 |

Test for Residue Formation.

In an air convection heating oven a stainless steel sheet (1.5*200*100 mm) is placed at an angle of 35°. Oil is dropped via a pipe 10 mm from the upper edge on the steel sheet from a distance of 85 mm at a speed of 1 drop in 6.6 min. During the test duration of 48 h 22 ml of oil are spent. The oil dripping off the steel sheet is recovered in a plate. Table 2 shows the test results.

TABLE 11

(test result of high temperature residue test at 240° C./48 h)

| | Hatcol 5150 | Ex. 1 | Ex. 2 | Ex. 3 | Ex. 4 | Ex. 5 | Ex. 6 |
|---|---|---|---|---|---|---|---|
| Hatcol 5150 | 100 | 99 | 93 | 95.7 | 95.85 | 96 | 98.7 |
| Diphenylamine. styrenated | 0 | 1 | 4 | 4 | 2.5 | 1 | 1 |
| HDPimid | | 0 | 3 | 0.3 | 1.65 | 3 | 0.3 |
| dynamic shear viscosity. cone plate. 300 1/sec. 20° C. after 30 sec shearing. Anton Paar Rheometer MCR51. DIN 51810 | 400 | 409 | 456 | 452 | 450 | 437 | 450 |
| dynamic viscosity of oil in plate after test; 20° C. 300 1/sec. after 30 sec; DIN standard 51810 | solid | solid | 1574 | 1322 | 2222 | 5165 | solid |
| visual inspection of steel sheet. surface are covered by brown hard residues | 20% | 20% | 0% | 2% | 5% | 10% | 10% |
| weight gain of steel sheet (g) | 0.68 | 0.19 | 0.1 | 0.07 | 0.08 | 0.19 | 0.33 |
| weight gain of plate (g); recovered oil | 1.34 | 1.97 | 11.88 | 13.5 | 12.28 | 8.9 | 2.53 |

The Table 11 shows that by adding ionic liquid the amount of recovered oil is higher and the shear viscosity of the oil is still low. Samples with insufficient additive show solidifications. The amount of brown oil residues on the plate also can be suppressed by using aminic antioxidant and ionic liquid in combination. The sample with highest additive amount does not show any residue. The weight gain of 0.1 g on the steel plate can be explained by the lubricating oil on the sheet.

Test for long term temperature stability at 200° C.

In two aluminum cups with diameter of 64 mm and 28 ml volume 5 g and 6 g of the samples shown in Table 10 are placed in an forced air oven (Typ Binder FD 54) at 200° C. The cup with 5 g is used to record the evaporation weight loss. the cup with 6 g is used to measure the change in shear viscosity using the standard shown in Table 11. For the shear viscosity test the sample amount is higher because the measurement consumes lubricant. The samples are measured approximately every 48 h. The experiment is stopped as soon as the shear rate of 300 1/sec can not be reached any more because the sample has thickened too much.

TABLE 12

(evaporation weight loss. 200° C.)

| | Ex. 1 | Ex. 2 | Ex. 3 | Ex. 4 | Ex. 5 | Ex. 6 |
|---|---|---|---|---|---|---|
| Hatcol 5150 | 99 | 93 | 95.7 | 95.85 | 96 | 98.7 |
| Diphenylamine, styrenated | 1 | 4 | 4 | 2.5 | 1 | 1 |
| HDPimid | 0 | 3 | 0.3 | 1.65 | 3 | 0.3 |
| long term temperature stability, 200° C. evaporation weight loss (%) | | | | | | |
| hour (h) | | | | | | |
| 0 | 0 | 0 | 0 | 0 | 0 | 0 |
| 48 | 22.84 | 3.98 | 5.49 | 3.98 | 2.76 | 8.4 |
| 168 | 72.1 | 7.3 | 26.54 | 5.3 | 3.38 | 36.48 |
| 216 | 76.18 | 8.62 | 34.31 | 6.08 | 8.5 | 47.76 |
| 288 | | 10.92 | 42.09 | 8.1 | 20.46 | 56.1 |

TABLE 12-continued

| (evaporation weight loss. 200° C.) | | | | | | |
|---|---|---|---|---|---|---|
| | Ex. 1 | Ex. 2 | Ex. 3 | Ex. 4 | Ex. 5 | Ex. 6 |
| 336 | | 12.16 | 45.17 | 16.56 | 24.34 | 60.3 |
| 384 | | 13.8 | 48.48 | 24.38 | 27.54 | 63.18 |
| 456 | | 16.22 | 53.04 | 30.08 | 33.26 | 66.52 |
| 504 | | 18.2 | 55.87 | 33.34 | 35.26 | |
| 552 | | 20.06 | 58.21 | 36.24 | 38.06 | |
| 624 | | 23.16 | 61.32 | 40.76 | 42.48 | |
| 672 | | 25.86 | 65.07 | 43.26 | 44.66 | |
| 720 | | 28.16 | 66.92 | 45.82 | 46.92 | |
| 802 | | 31.78 | 69.32 | 49.58 | 50.2 | |
| 844 | | 33.82 | 70.79 | 51.86 | 52.26 | |
| 892 | | 36.22 | 72.2 | 53.6 | 54.04 | |
| 988 | | 40.7 | | 57.86 | 58.04 | |
| 1060 | | 43.66 | | 60.48 | 60.56 | |
| 1132 | | 47.7 | | | | |
| 1185 | | 49.84 | | | | |
| 1233 | | 52.44 | | | | |
| 1305 | | 55.98 | | | | |
| 1353 | | 58.4 | | | | |

TABLE 13

| (shear viscosity. 200° C.) | | | | | | |
|---|---|---|---|---|---|---|
| | Ex. 1 | Ex. 2 | Ex. 3 | Ex. 4 | Ex. 5 | Ex. 6 |
| Hatcol 5150 | 99 | 93 | 95.7 | 95.85 | 96 | 98.7 |
| Diphenylamine, styrenated | 1 | 4 | 4 | 2.5 | 1 | 1 |
| HDPimid | 0 | 3 | 0.3 | 1.65 | 3 | 0.3 |
| long term temperature stability, 200° C. hour (h) | shear viscosity mPas | | | | | |
| 0 | 409 | 456 | 452 | 450 | 437 | 450 |
| 48 | 497 | 584 | 575 | 571 | 502 | 493 |
| 168 | 58042 | 639 | 660 | 590 | 530 | 1140 |
| 216 | 404480 | 670 | 768 | 664 | 624 | 3812 |
| 288 | | 675 | 1579 | 653 | 1104 | 13649 |
| 336 | | 1528 | 1855 | 940 | 1418 | 28522 |
| 384 | | 916 | 2420 | 1298 | 1712 | 59358 |
| 456 | | 973 | 3591 | 1804 | 2309 | 300000 |
| 504 | | 1235 | 5113 | 2175 | 3005 | |
| 552 | | 1258 | 6964 | 2716 | 3862 | |
| 624 | | 1405 | 95000 | 3920 | 5821 | |
| 672 | | 1493 | 18467 | 5888 | 7851 | |
| 720 | | 1643 | 28930 | 7022 | 10734 | |
| 802 | | 1725 | 60206 | 10870 | 18692 | |
| 844 | | 2637 | 64300 | 13736 | 25749 | |
| 892 | | 2630 | 132771 | 20419 | 41243 | |
| 988 | | 3193 | | 49009 | 78318 | |
| 1060 | | 7111 | | | | |
| 1132 | | 5877 | | | | |
| 1185 | | 10836 | | | | |
| 1233 | | 15780 | | | | |
| 1305 | | 49111 | | | | |
| 1353 | | 37685 | | | | |

Table 13 shows that by using Ionic liquid and the aminic antioxidant the increase in shear viscosity can be lowered considerably.

Table 12 shows that the evaporation can be suppressed by use of the ionic liquid. Taking the time until 50% of the sample are evaporated a lifetime formula can be set up, relating the additive concentrations with the evaporation loss (evl). The relevant values can be found in table 14.

TABLE 14

| (values for 50% evaporation loss deduced from Table 13 for statistical evaluation) | | | | | | |
|---|---|---|---|---|---|---|
| | Ex. 1 | Ex. 2 | Ex. 3 | Ex. 4 | Ex. 5 | Ex. 6 |
| Hatcol 5150 (%) | 99 | 93 | 95.7 | 95.85 | 96 | 98.7 |
| Diphenylamine, styrenated (%) | 1 | 4 | 4 | 2.5 | 1 | 1 |
| HDPimid (%) | 0 | 3 | 0.3 | 1.65 | 3 | 0.3 |
| 50% evaporation [h] weight loss. 200° C. = t_50%_evl | 114 | 1188 | 408 | 810 | 797 | 235 |

t_50%_evl = 42.8 h + 248.4 h* % HDPimid + 93.9 h* % (Diphenylamine, styrenated)

The formula shows that both additives improve the lifetime at 200° C., but the influence of the Ionic liquid is higher then the influence of the aminic antioxidant The aminic antioxidant, diphenylamine styrenated belongs to the group of aralkylated diphenylamines, which are used in high temperature applications preferably due to her high molecular weight.:

(1)

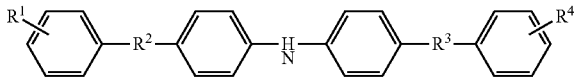

wherein $R^1$ and $R^4$ each independently represent a $C_0$ to $C_{24}$ alkyl group, and $R^2$ and $R^3$ each independently represent a $C_1$ to $C_5$ alkylene group, more preferably a $C_1$ to $C_3$ alkylene group. $C_0$ means that the corresponding substituent $R_1$ or $R_4$ is not present. Specific examples of the aralkylated diphenylamine include 4.4'-bis(α,α-dimethylbenzyl)diphenylamine, 4,4'-diphenethyldiphenylamine and 4,4' bis(α-methylbenzyl) diphenylamine.

What is claimed is:

1. A method of enabling operation of chains, steel belts, wheel bearings, roller bearings, binding rods, wood presses, chain carpets, film stretching machines, drying or polymerization ovens in the glass wool, rockwool and plasterboard industry, sliding bearings (contacts) and electric motors for at least 48 hours by reducing the evaporation loss and the lackification tendency of a lubricant, comprising the steps of:

applying a liquid lubricant having a kinematic viscosity at 40° C. between 50 $mm^2$/sec and 1000 $mm^2$/sec and comprising a mixture of (a) 99.3 to 30 weight % of a base oil or a base oil mixture of at least one synthetic oil, group III oils, native oils;

(b) 0 to 50 weight % of a polymer or polymer mixture based on polyisobutylene, which can be partly or fully hydrogenated;

(c) 0.1 to 2.0 weight % of an ionic liquid or mixtures of ionic liquids; and (d) 0.5 to 10 weight % of additives or additive mixtures; and operating said one of chains, steel belts, wheel bearings, roller bearings, binding rods, wood presses, chain carpets, film stretching machines, drying or polymerization ovens in the glass wool, rockwool and plasterboard industry, sliding bearings (contacts) and electric motors for at least 48 hours without lackification of the lubricant.

2. The method as claimed in claim 1, wherein the component (a) based on a synthetic oil is selected from esters of aromatic or aliphatic di-, tri- or tetracarboxylic acids with one or a mixture of $C_7$ to $C_{22}$ alcohols, a polyphenyl ether or alkylated di- or triphenyl ether, an ester of trimethylolpropane, pentaerythritol or dipentaerythritol with aliphatic $C_7$ to $C_{22}$ carboxylic acids, from $C_{18}$ dimeric acid esters with $C_7$ to $C_{22}$ alcohols, from complex esters, as single components or in any mixture; poly-α-olefins, alkylated naphthalenes, alkylated benzenes, polyglycols, silicone oils, perfluoropolyethers.

3. The method as claimed in claim 1, wherein the component (a) based on group III oils are selected from paraffin-based oils, naphthene-based and aromatic hydrocracking oils; gas-to-liquid (GTL) fluids, coal-to-liquid process (CTL) fluids or biomass-to-liquid (BTL) fluids.

4. The method as claimed in claim 1, wherein the component (a) based on native oils are selected from triglyceride oils with a high oleic acid content, vegetable oils with a high oleic acid including safflower oil, corn oil, canola oil, sunflower oil, soy oil, linseed oil, peanut oil, lesquerella oil, meadowfoam oil and palm oil.

5. The method as claimed in claim 1, wherein the component (c) is a ionic liquid containing a cation selected from the group consisting of a quaternary ammonium cation, a phosphonium cation, an imidazolium cation, a pyridinium cation, a pyrazolium cation, an oxazolium cation, a pyrrolidinium cation, a piperidinium cation, a thiazolium cation, a guanidinium cation, a morpholinium cation, a trialkylsulfonium cation or a triazolium cation, and an anion selected from the group consisting of $[PF_6]^-$, $[BF_4]^-$, $[CF_3CO_2]^-$, $[CF_3SO_3]^-$ as well as its higher homologs, $[C_4F_9—SO_3]^-$ or $[C_8F_{17}—SO_3]^-$ and higher perfluoroalkylsulfonates, $[(CF_3SO_2)_2N]^-$, $[(CF_3SO_2)(CF_3COO)]N]^-$, $[R^4—SO_3]^-$, $[R^4—O—SO_3]^-$, $[R^4—COO]^-$, $Cl^-$, $Br^-$, $[NO_3]^-$, $[N(CN)_2]^-$, $[HSO_4]^-$, $PF_{(6-x)}R^6_x$ or $[R^4R^5PO_4]^-$ and the radicals $R^4$ and $R^5$ independently of one another are selected from hydrogen; linear or branched, saturated or unsaturated, aliphatic or alicyclic alkyl groups with 1 to 20 carbon atoms; heteroaryl, heteroaryl-$C_1$-$C_6$-alkyl groups with 3 to 8 carbon atoms in the heteroaryl radical and at least one heteroatom of N, O and S, which may be combined with at least one group selected from $C_1$-$C_6$ alkyl groups and/or halogen atoms; aryl-aryl $C_1$-$C_6$ alkyl groups with 5 to 12 carbon atoms in the aryl radical, which may be substituted with at least one $C_1$-$C_6$ alkyl group; $R^6$ may be a perfluoroethyl group or a higher perfluoroalkyl group, x is 1 to 4.

6. A method as claimed in claim 1 wherein component (c) is a ionic liquids selected from the group consisting of butylmethylpyrrolidinium bis(trifluoromethylsulfonyl) imide (MBPimide), methylpropylpyrrolidinium bis(trifluoromethylsulfonyl) imide (MPPimide), hexylmethylimidazolium tris(perfluoroethyl)trifluorophosphate (HMIMPFET), hexylmethylimidazolium bis(trifluoromethylsulfonyl)imide (HMIMimide), hexylmethylpyrrolidinium bis(trifluoromethylsulfonyl) imide (HMP), tetrabutylphosphonium tris(perfluoroethyl)trifluorophosphate (BuPPFET), octylmethylimidazolium hexafluorophosphate (OMIM PF6), hexylpyridinium bis(trifluoromethyl)sulfonylimide (Hpyimide), methyltrioctylammonium trifluoroacetate (MOAac), butylmethylpyrrolidinium tris(pentafluoroethyl)trifluorophosphate (MBPPFET), trihexyl(tetradecyl)phosphonium bis(trifluoromethylsulfonyl)imide (HPDimide), trihexyl(tetradecyl)phosphonium tris(pentafluoroethyl) trifluorophosphate (HPDPFET).

7. The method as claimed in claim 1, wherein component (c) comprises only hydrophobic anions of the group of hydrophobic anions of the group of bis(fluoralkylsulfonyl)imide, tris(pentafluorethyl)trifluorphosphate and cations selected from tetraalkylphosphonium, and tetraalkylammonium.

8. The method as claimed in claim 1, wherein component (c) comprises only hydrophobic anions of the group of hydrophobic anions of the group of bis(fluoralkylsulfonyl)imide, tris(pentafluorethyl)trifluorphosphate and cations containing at least 10 carbon atoms in the hydrocarbon groups.

9. The method as claimed in claim 1, wherein component (c) comprises only hydrophobic anions of the group of hydrophobic anions of the group of bis(fluoralkylsulfonyl)imide, tris(pentafluorethyl)trifluorphosphate and cations selected from tetraalkylphosphonium, and tetraalkylammonium and cations selected from tetraalkylphosphonium and tetraalkylammonium containing at least 10 carbon atoms in the hydrocarbon groups.

10. The method as claimed in claim 1, wherein component (d) is selected from the group consisting of anticorrosion agents, antioxidants, wear preservatives, friction-reducing agents, agents to protect against the effects of metals which are present as chelate compounds, radical scavengers, UV stabilizers, reaction-layer-forming agents; organic or inorganic solid lubricants such as polyimide, polytetrafluoroethylene (PTFE), graphite, metal oxides, boron nitride, molybdenum disulfide and phosphate.

11. The method as claimed in claim 1, wherein component (d) further comprises at least 0.5 weight % aminic antioxidant or a mixtures of aminic antioxidants referring to the weight of the whole liquid lubricant.

12. The method as claimed in claim 11, wherein the aminic antioxidants is an aralkylated aminic antioxidant.

* * * * *